United States Patent [19]

Marten

[11] Patent Number: 4,662,684

[45] Date of Patent: May 5, 1987

[54] ROTARY ROCK AND TRENCH CUTTING SAW

[75] Inventor: Edward N. Marten, Von Ormy, Tex.

[73] Assignee: H. B. Zachery Corporation, San Antonio, Tex.

[21] Appl. No.: 614,460

[22] Filed: May 25, 1984

Related U.S. Application Data

[63] Continuation-in-part of Ser. No. 103,231, Dec. 13, 1979, Pat. No. 4,542,940, which is a continuation-in-part of Ser. No. 966,338, Dec. 4, 1978, Pat. No. 4,230,372.

[51] Int. Cl.[4] ..... E21C 29/24; E21C 27/10

[52] U.S. Cl. ..... 299/1; 299/39; 299/36

[58] Field of Search ..... 299/1, 15, 39, 72, 76; 173/22, 42, 43

[56] References Cited

U.S. PATENT DOCUMENTS

| | | | |
|---|---|---|---|
| 2,517,267 | 8/1950 | Watson | 262/28 |
| 3,460,691 | 8/1969 | Wieger et al. | 214/141 |
| 3,550,961 | 12/1970 | Hughes | 299/71 |
| 3,596,997 | 8/1971 | Valantin | 299/72 |
| 3,750,762 | 8/1973 | Eaton | 173/8 |
| 3,785,705 | 1/1974 | Binger et al. | 299/75 |
| 3,945,138 | 3/1976 | Heusler et al. | 299/1 X |
| 4,274,494 | 6/1981 | Bergström | 173/43 |

FOREIGN PATENT DOCUMENTS

| | | | |
|---|---|---|---|
| 1228997 | 9/1960 | France . | |
| 0184129 | 11/1982 | Japan | 173/22 |
| 1368344 | 9/1974 | United Kingdom . | |

*Primary Examiner*—Stephen J. Novosad
*Assistant Examiner*—Thomas J. Odar
*Attorney, Agent, or Firm*—Hubbard, Thurman, Turner, & Tucker

[57] ABSTRACT

A rotary trench cutting or rock milling saw unit is supported on a head for movement about two mutually perpendicular axes. The head is adapted for pivotal mounting on a backhoe boom or similar positioning structure. Rotary rock cutting wheels are driven by a hydraulic motor and a support vehicle for the saw unit includes a hydrostatic drive system with a variable displacement hydraulic pump driving variable displacement track drive motors which may be set in a slow speed operating mode for trench cutting operations or a high speed mode for tramming between work sites. A constant rate of power input to the saw unit is maintained by sensing saw drive motor supply pressure and adjusting track drive motor supply pump displacement to maintain a constant feed or rock cutting rate. The apparatus includes hydraulically operated actuators for rotating the saw unit and its support boom about a vertical axis with respect to the apparatus undercarriage, elevating the boom with respect to the undercarriage, and moving the saw unit about three mutually perpendicular axes with respect to the support boom. Each of the actuators includes a control valve which may be selectively positioned to operate the actuators in reverse directions, lock the actuators in a predetermined position, or permit the actuators to oscillate or rotate the saw unit with respect to the various positioning axes of rotation when the saw unit is confined in a trench.

20 Claims, 11 Drawing Figures

ROTARY ROCK AND TRENCH CUTTING SAW

CROSS REFERENCE TO RELATED APPLICATION

This application is a continuation-in-part of application Ser. No. 103,231 filed Dec. 13, 1979 now U.S. Pat. No. 4,542,940 which is a continuation-in-part of application Ser. No. 966,338 filed Dec. 4, 1978, now U.S. Pat. No. 4,230,372.

BACKGROUND OF THE INVENTION

1. Field Of The Invention

The present invention pertains to a motor driven rotary saw apparatus for earth trenching and rock or concrete cutting applications. The saw head is provided with a universal mounting structure for mounting the saw head on the end of an elongated boom supported on a transport undercarriage.

2. Background

In the art of rotary rock cutting and trenching saws there have been several developments in regard to saw mounting structure which provide for positioning the rotary saw head in a desired attitude for cutting trenches and performing other rock removal operations whereby the saw is traversed along a predetermined path. Although it has been previously accepted to provide a saw head which is mounted for movement about two mutually perpendicular axes with respect to a boom or other support structure, prior art types of supports have been limited with respect to the freedom of movement of the saw head to position it in the desired attitude. The prior art type of mounting structure thus requires a specialized undercarriage and support boom for the saw head in order to provide for the requisite degrees of freedom of movement of the head. Even so, the prior art specialized saw head support structure and previous attempts to modify conventional support structures, such as backhoe booms and the like, have not been satisfactory to provide the desired degree of freedom of orienting the saw blades. This is particularly a problem in trenching operations wherein the saw is cutting a trench to a depth requiring several passes of the saw by making successively deeper cuts with each pass and wherein the saw must be maintained aligned with the portions of the trench formed by previous cutting operations. Moreover, there are certain applications which can advantageously use a rotary rock saw which require positioning the saw adjacent to a vertical or inclined wall for milling operations to form a substantially smooth wall surface in a predetermined plane.

The requirement for improved saw head mounting structure has also dictated a need for controls for positioning the saw head and for allowing the saw head to follow a predetermined course in trench cutting operations, in particular.

Furthermore, there has also been a need for improvements in controls for providing a substantially constant energy input to the saw cutting or trenching operation to maximize the efficiency of the operation of the saw and its drive system. The improvements in the saw unit supporting structure provided by the present invention together with the improved control circuits for positioning and operating the saw in conjunction with traversal of the supporting undercarriage provide a somewhat synergistic effect in the art of hydraulically powered rotary trenching and rock cutting saw apparatus as will be recognized by those skilled in the art.

SUMMARY OF THE INVENTION

The present invention provides an improved rotary, motor driven trenching or rock cutting saw unit having a unique support head which is operable to orient the plane of rotation of the saw cutting wheel or wheels in a predetermined direction and wherein the saw wheels are provided with three degrees of freedom of movement with respect to a support boom for the saw unit itself.

In accordance with one aspect of the present invention, there is provided an improved rotary rock and trench cutting saw unit adapted for support by a ground traversing undercarriage wherein the saw may be more easily maintained to traverse a predetermined path during an initial cut or kerf in a trench cutting operation as well as form successively deeper cuts in a previously cut trench or the like. The saw unit includes a head which is adapted for mounting on the end of a boom and being pivotable about three mutually perpendicular axes whereby the plane of rotation of the saw wheels may be maintained in a predetermined attitude and allowed to follow a previously cut trench more easily than possible with prior art saw supporting structures.

In accordance with the invention, the saw unit support head is adapted for mounting on the end of an elongated boom for movement about a first generally horizontal pivot axis. The support head is also provided with a rotary drive mechanism for rotating the saw unit about an axis, perpendicular to the first pivot axis, and the saw unit includes means forming a third pivot axis between a rotary saw wheel support frame and the support head, the third pivot axis being perpendicular to the first and second pivot axes. The saw unit is preferably positioned with respect to the rotary drive portion of the head about the third pivot axes by plural spaced apart hydraulic cylinder and piston members which are adaptable to support the saw unit in a predetermined angular position with respect to the support head or to allow the saw wheels to be guided by the walls of the kerf being formed by the saw wheels, a previously cut trench or other surface.

With the universal saw unit support head of the present invention, the improved rotary rock cutting saw is particularly adapted for use with conventional support booms of the type typically mounted on excavating apparatus such as backhoes and similar type of equipment.

In accordance with a further aspect of the invention the saw unit is provided with a unique positioning control circuit which provides for positive predetermined positioning of the saw wheels about plural pivot axes, allows one, two or three degrees of freedom of movement of the saw unit relative to a support boom, and allows freedom of movement of the support boom about a vertical pivot axis relative to a boom supporting undercarriage.

In accordance with still another aspect of the present invention, there is provided a hydraulic motor powered rotary rock saw having an improved hydraulic control circuit for maintaining a substantially constant rate of energy input to a trench or rock cutting operation. The control circuit includes a pressure sensing control valve which is operable to adjust the rate of propulsion of a supporting undercarriage for the saw unit to maintain a substantially constant speed of rotation of the saw cutting wheels and provide a relatively constant rate of rock removal or cutting action of the saws.

Those skilled in the art will further appreciate the above/described features and advantages of the present invention as well as other superior aspects thereof upon reading the detailed description which follows in conjunction with the drawing.

DESCRIPTION OF THE PREFERRED EMBODIMENT

Figure 1:
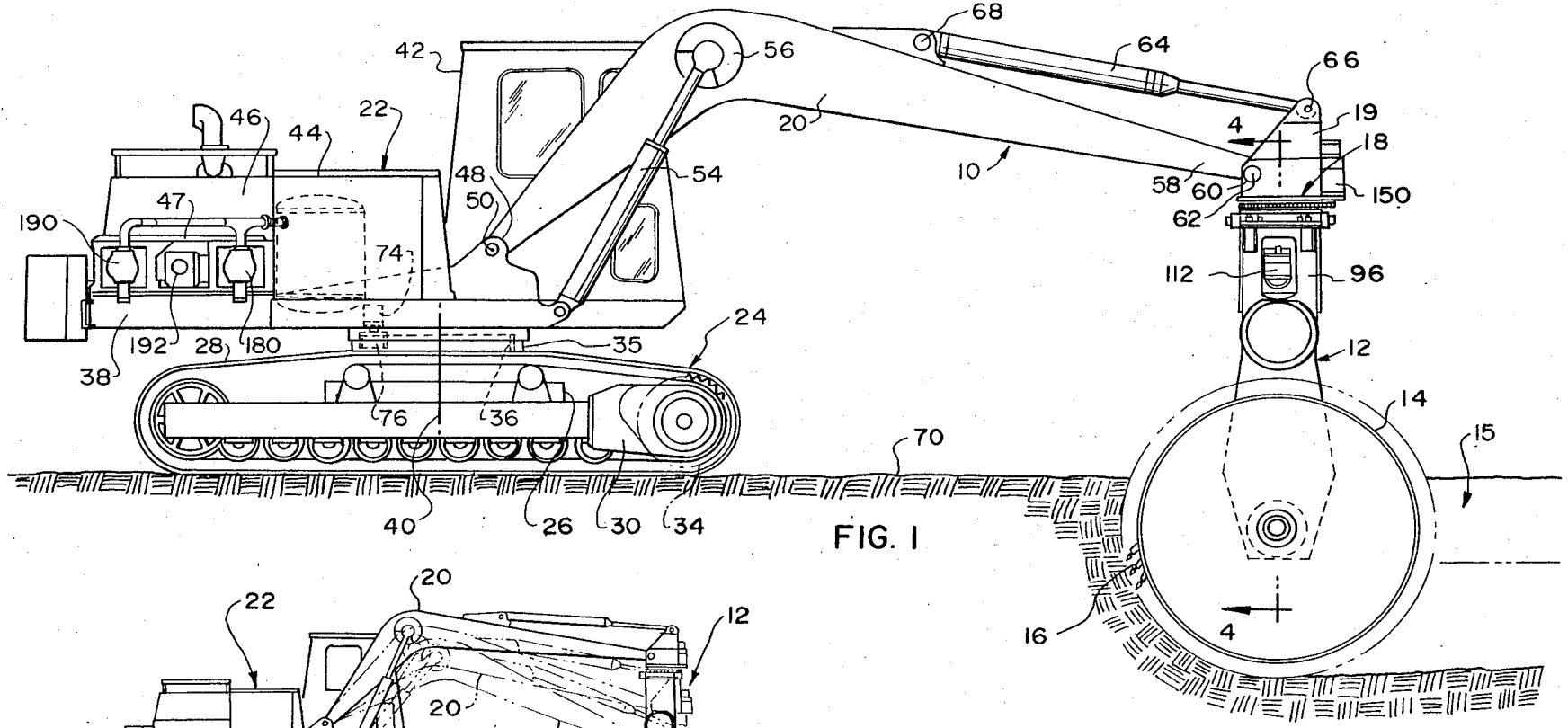
FIG. 1 is a side elevation of a trench and rock cutting saw apparatus of the present invention mounted on a self-propelled track type undercarriage and support boom.

In the description which follows, like parts are marked throughout the specification and drawing with the same reference numerals, respectively. The drawings are not necessarily to scale and certain features may be shown exaggerated in scale or in somewhat schematic form in the interest in clarity and conciseness.

Figure 2:
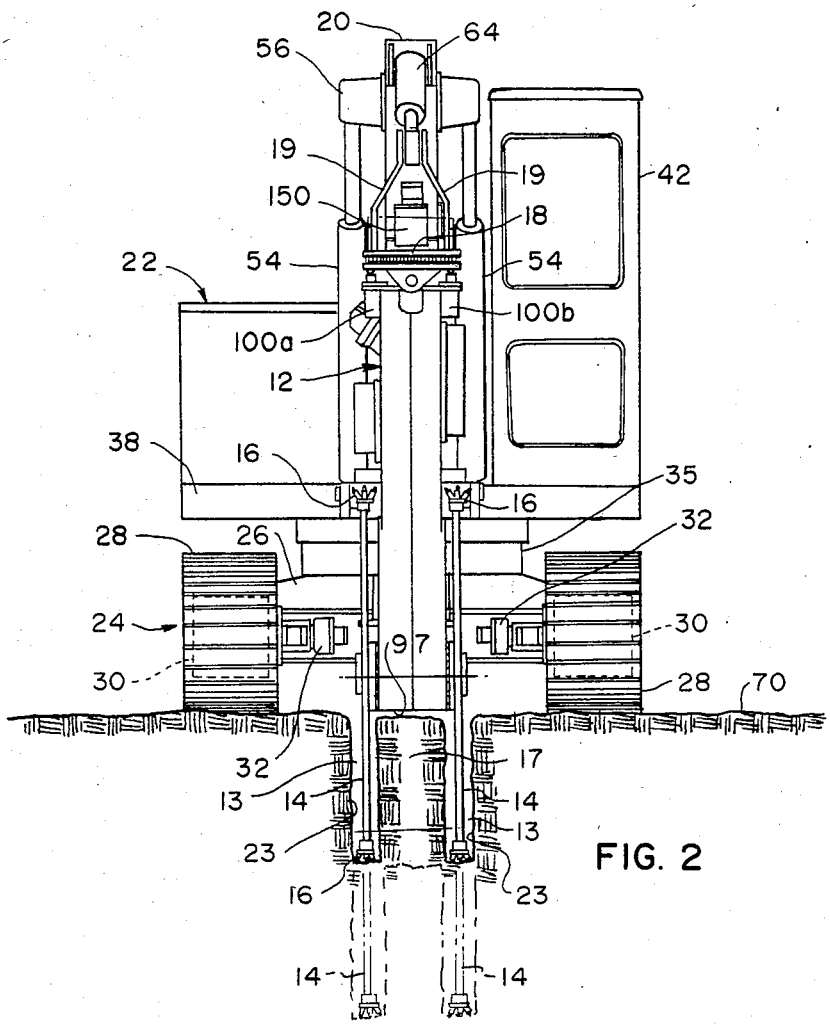
FIG. 2 is a front elevation of the rock cutting saw apparatus.

Referring to FIGS. 1 and 2, the improved rock and trench cutting saw of the present invention is illustrated and generally designated by the numeral 10. The rock cutting saw apparatus 10 includes a rotary rock cutting saw unit 12 having a pair of spaced apart cylindrical cutting wheels 14 which are provided with suitable rock cutting teeth 16 spaced apart about the circumference of the wheels for cutting relatively thin trenchlike cuts or for performing face milling operations as will be described in further detail herein. The saw unit 12 includes a support head 18 which is mounted on the end of an elongated boom 20 which is pivotally supported on a self-propelled track or crawler type vehicle generally designated by the numeral 22. The vehicle 22 is typically of a type which may be adapted for use as an excavating apparatus known in the art as a backhoe. In the specific configuration of the saw apparatus 10, an excavating bucket, normally mounted on the distal end of the boom 20, has been removed in favor of mounting of the saw unit 12 and head 18 thereon. The vehicle 22 is further modified in accordance with the present invention as will also be explained herein.

The vehicle 22 comprises an undercarriage 24 having a frame 26 and propulsion wheel means comprising a pair of spaced apart endless crawler tracks 28. The tracks 28 are each driven by a hydraulic motor powered track drive unit 30 comprising a positive displacement hydraulic motor 32 driving a track drive sprocket 34, FIG. 1, through suitable reduction gearing, not shown. Specific details of the track drive units 30 are not believed to be necessary to enable one to practice the present invention. One type of track drive unit which may be used in conjunction with the vehicle 22 is described in U.S. Pat. No. 3,901,336 to H. Bendure.

The frame 26 includes a conventional, generally cylindrical bearing structure 35 including a ring gear 36 mounted thereon and adapted to support a platform 38 for rotary movement about a vertical axis 40 with respect to the tracks 28. The platform 38 includes an operator's cab 42 disposed thereon and an enclosure 44 for housing a prime mover such as a diesel engine 46 driving one or more hydraulic pumps to be described further herein. The platform 38 also supports the boom 20 at a pivot connection 48 for pivotal movement about a horizontal axis 50. The boom 20 is supported with respect to the platform 38 by actuator means comprising dual hydraulic cylinder and piston assemblies 54 connected at one end to the platform 38 and at their opposite ends to the boom 20 at pivot connections 56 for movement of the boom in a generally vertical plane.

Figure 4:
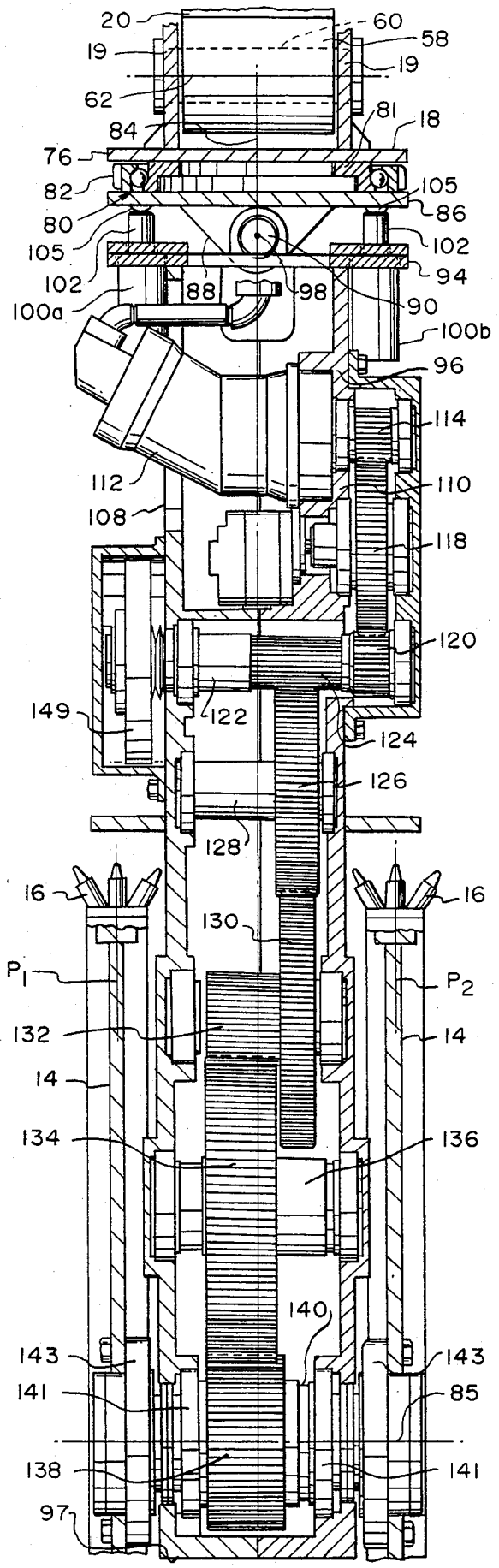
FIG. 4 is a section view taken along the line 4—4 of FIG. 1.

The distal end 58 of the boom 20 supports a pivot pin 60 extending between and journalled by spaced apart support brackets 19, FIGS. 2 and 4, on the head 18 and forming a pivotal connection between the boom and the head 18 whereby the head 18 and the saw unit 12 may be pivoted about a generally horizontal axis 62. An elongated hydraulic cylinder and piston type actuator 64 is connected to the boom 20 and the brackets 19 at pivot connections 66 and 68, respectively. Accordingly, the rotary saw unit 12 may be raised and lowered with respect to the earth's surface 70 by actuation of the cylinder actuators 54 and the saw unit 12 may be pivoted about the horizontal axis 62 by actuation of the cylinder actuator 64. As shown in FIG. 1, the platform 38 is provided with drive mechanism for rotating the platform with respect to the undercarriage frame 26 comprising a hydraulic motor 74 drivably connected to a pinion 76 which is meshed with the ring gear 36 for rotating the platform 38 about the vertical axis 40. Accordingly, the saw unit 12 may also be positioned with respect to the vehicle 22 about the mutually perpendicular axes 40 and 50 and the mutually perpendicular axes 40 and 62.

Figure 3:
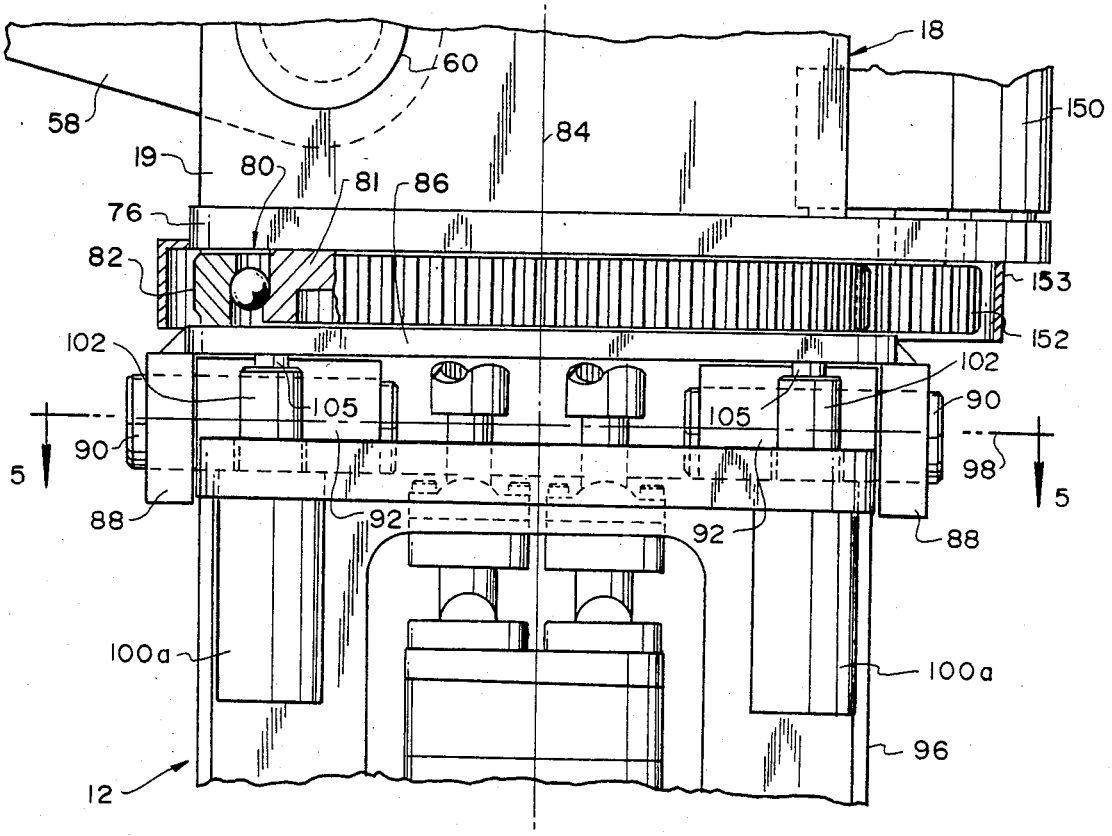
FIG. 3 is a detail view on a larger scale of the saw unit and support head.
Figure 5:
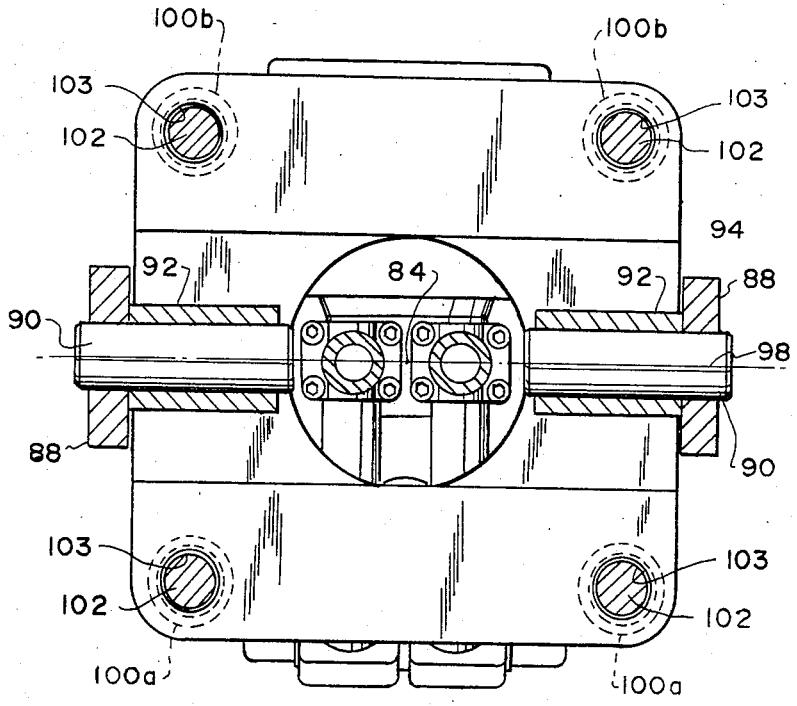
FIG. 5 is a section view taken along the line 5—5 of FIG. 3.

The support structure for the saw unit 12, which comprises the head 18 and its connection to the distal end of boom 20, provides for movement of the cutting wheels 14 substantially universally with respect to the boom 20 about three mutually perpendicular axes. Referring now to FIGS. 3, 4 and 5, the head 18 includes a transverse support plate 76 secured to the two spaced apart upstanding support brackets 19. A suitable antifriction bearing assembly 80 is secured on the bottom side of the plate 76 and supports a gear 82 for rotation about a normally vertical axis 84. The gear 82 may comprise the outer race of the bearing assembly 80, as shown. The bearing inner race 81 is suitably secured to the plate 76. The gear 82 is secured to a second transverse support plate 86 which is provided with two opposed and aligned pivot bearing blocks 88 for supporting respective bearing pins 90. The bearing pins 90 are also journalled in spaced apart bearing blocks 92 secured to a third transverse plate 94 forming a part of a frame 96 for the saw unit 12. Accordingly, the frame 96 is supported by the head 18 for limited rotation about a normally horizontal axis 98 which is perpendicular to the axis 84. Moreover, the axes 84 and 98 are both perpendicular to the pivot axis 62 of the head 18. The axis 84 lies in a plane parallel to the planes of rotation $P_1$ and $P_2$, FIG. 4, of the respective saw wheels 14 and preferably equally spaced from said planes of rotation. The axis 84 also preferably intersects the axis of rotation 85 of the saw wheels 14, as indicated in FIG. 4. The axis 98 also preferably intersects the axis 84 and extends in the same plane as the axis 84 and parallel to the planes of rotation of the saw wheels 14.

Referring further to FIGS. 3, 4 and 5, the frame 96 is provided with four spaced apart hydraulic cylinder and piston actuators 100*a* and 100*b* which are supported on the frame plate 94 and include respective piston rods 102 which extend through clearance bores 103 in the plate 94 and are engageable with respective curved wear surfaces 105 on the support plate 86. Respective pairs of the cylinder actuators 100*a* and 100*b* are hydraulically interconnected in such a way that the cylinders 100*b* are operable to rotate the frame 96 in a clockwise direction about the axis 98, viewing FIG. 4, by extending their respective piston rods 102 and the cylinders 100*a* are, in like manner, operable to rotate the frame 96 in the opposite direction about the axis 98. The range of movement of the frame 96 with respect to the plate 86 is typically approximately 10° to 15° in either direction with respect to the axis 84, viewing FIG. 4. The actuators 100*a* and 100*b* are preferably single acting spring biased return types which are hydraulically energized to extend their respective piston rods 102.

Referring further to FIG. 4, the frame 96 includes a pair of spaced apart frame plates 108 and 110 which are adapted to support a reversible positive displacement hydraulic motor 112 thereon and drivably connected to the rotary saw wheels 14 through a gear train comprising a pinion 114 drivably connected to the motor 112 and meshed with a gear 118. The gear 118 is rotatably mounted on frame 96 and 112 meshed with a pinion 120 supported on a countershaft 122 which includes a pinion 124 meshed with a gear 126 on a second countershaft 128. The gear 126 is meshed with a gear 130 which in turn is drivably connected to a pinion 132 meshed with a gear 134 on a third countershaft 136. The gear 134 is meshed with a pinion 138 supported on and drivably connected to a shaft 140 for supporting and driving the opposed saw wheels 14. The shaft 140 is mounted in suitable bearings 141 on the frame 96 and is drivably connected to the opposed saw wheels 14 through opposed hub members 143. The countershaft 122 is preferably provided with a flywheel 149 for maintaining suitable energy storage in the power train between the motor 112 and the saw wheels 14. The drive train between the motor 112 and the saw wheels 14 is not believed to require further detailed description to enable one to practice the present invention. A bottom frame plate 97 serves as a skid or protective cover for the drive mechanism of the saw unit 12.

Referring to FIG. 3, the saw frame 96 is rotatably driven about the axis 84 by a reversible hydraulic motor 150 which is mounted on the plate 76. The motor 150 is drivably connected to a pinion 152 which is meshed with the gear 82 for rotating the saw unit 12 including the frame 96 about the axis 84 and with respect to head 18. A suitable shield 153 is disposed on plate 76 and around the gears 82 and 152.

As previously described, the saw unit 12 may be positioned with respect to the vehicle undercarriage frame 26 by rotation of the platform 38 about the axis 40 by motor 74 and elevation of the boom 20 about the pivot axis 50 by the actuators 54. The saw unit 12 may also, of course, be pivoted about the three mutually perpendicular axes 62, 84 and 98 by actuation of the cylinder actuator 64, the motor 150 and the cylinder actuators 100*a* and 100*b*, respectively. The universally positionable saw unit 12 is particularly advantageous for applications of use of the saw unit on a conventional self-propelled vehicle of the type described herein whereby the saw unit may be positioned in a wide range of attitudes with respect to the vehicle undercarriage for cutting a trench in a predetermined direction and for making additional cuts in a trench already formed.

Figure 1A:
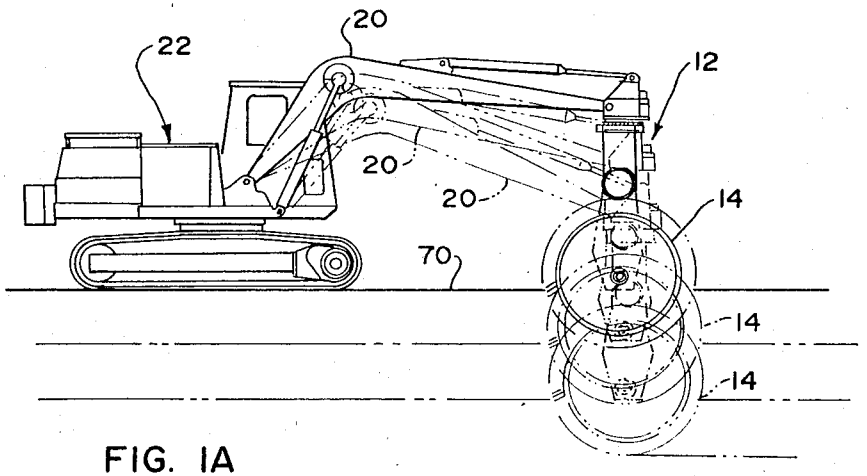
FIG. 1A is a side elevation view of the apparatus showing alternate positions of the saw unit in cutting successively deeper portions of a trench.

As shown in FIGS. 1, 1A and 2, the saw unit 12 may be positioned for cutting a trench 15 wherein the opposed tracks 28 straddled the trench. FIG. 2 illustrates the position of the saw wheels 14 in making initial spaced apart kerfs 13 to leave a continuous wall 17 which is subsequently broken out by suitable means, not shown. A second cut is then made by lowering the saw wheels 14 to the alternate position lines indicated in FIG. 2 which is also the position shown by solid lines in FIG. 1. In this position and subsequently deeper positions such as depicted in FIG. 1A, the outer sidewalls 23 of trench 15 constrain and somewhat guide the saw wheels 14.

During an initial cut in forming the trench 15, the actuators 54 and 64 are typically locked in a predetermined position to maintain the cutting depth of the saw wheels and the motor 150 and actuators 100*a* and 100*b* are normally locked hydraulically so that the saw wheels cut a trench along a predetermined path followed by the vehicle tracks 28. The vehicle track motors 32 may be selectively controlled to cause the vehicle 22 to traverse the desired path. However, under certain conditions the terrain or surface 70 may become uneven or tilted with respect to a plumb line whereas, since it is desired to, in many instances, cut the trench 15 with vertical sidewalls, the actuators 100*a* or 100*b* can be actuated to maintain the planes of rotation of the saw wheels 14 substantially vertical even though the undercarriage 24 may be traversing a laterally inclined surface.

As previously mentioned, during subsequent kerf forming operations to form the trench 15 to the desired depth, the saw wheels 14 are lowered in the trench and are somewhat constrained or guided by the outer trench sidewalls 23. Under these operating conditions, even though the guidance of the vehicle may be fairly accurate, it is desirable to allow the previously cut trench portions to serve as a guide for the saw wheels 14 during successively deeper cuts and since accurate positioning of the vehicle may be difficult, it is desirable to allow the saw unit 12 to move relative to the head 18 about the axes 84 and 98 so that the saw wheels 14 do not tend to bind or cut into the previously cut portions of the trench sidewalls 23. In accordance with the present invention, the apparatus 10 is provided with improved controls for positively positioning the saw unit 12 to prevent rotation of the frame 96 about the axes 84 and 98, or to selectively permit rotation or oscillation of the frame 96 about the respective axes 84 and 98. FIG. 1A illustrates alternate positions of the boom 20 and the saw unit 12 as the saw unit makes successively deeper second and third cuts after the initial cutting operation into the surface 70.

Although the apparatus 10 may be operated to form a trench 15 of a selected depth wherein the apparatus may straddle the trench during the cutting operations, there are many instances wherein the vehicle 22 must be set alongside the trench if the overall width of the trench is greater than the track width of the vehicle, or other terrain factors require that the vehicle be laterally spaced from the trench itself during the trench forming operations.

Figure 6:
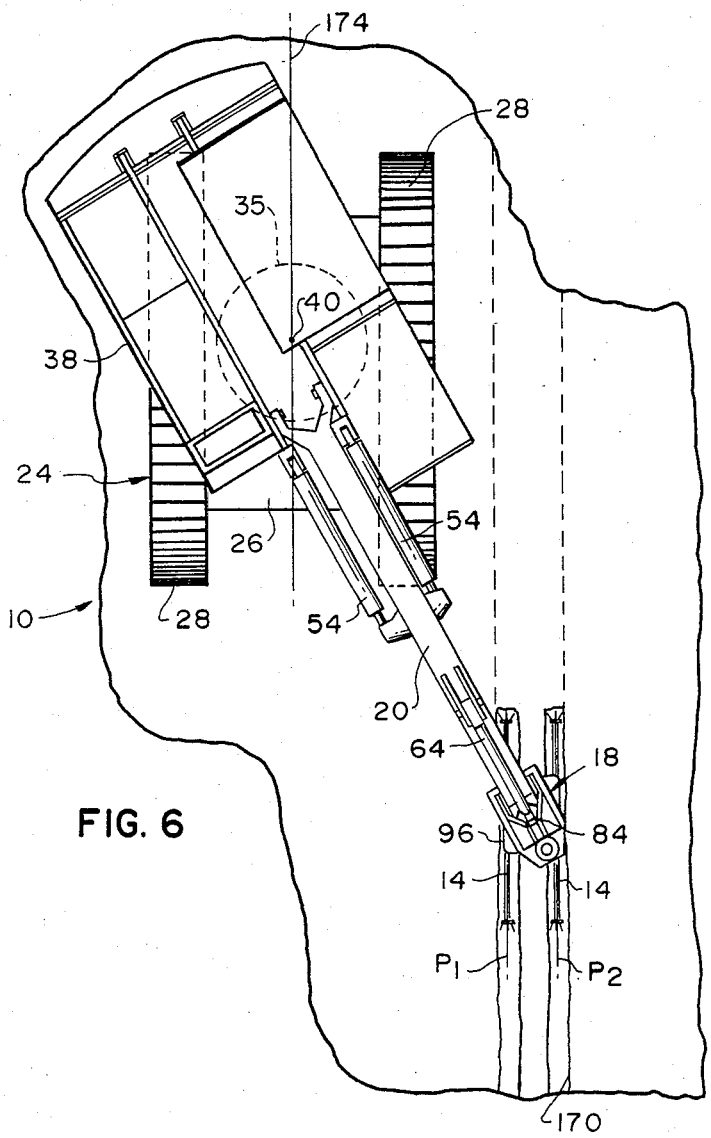
FIG. 6 is a top plan view of the apparatus cutting a trench in one orientation of the saw unit relative to its supporting undercarriage.
Figure 7:
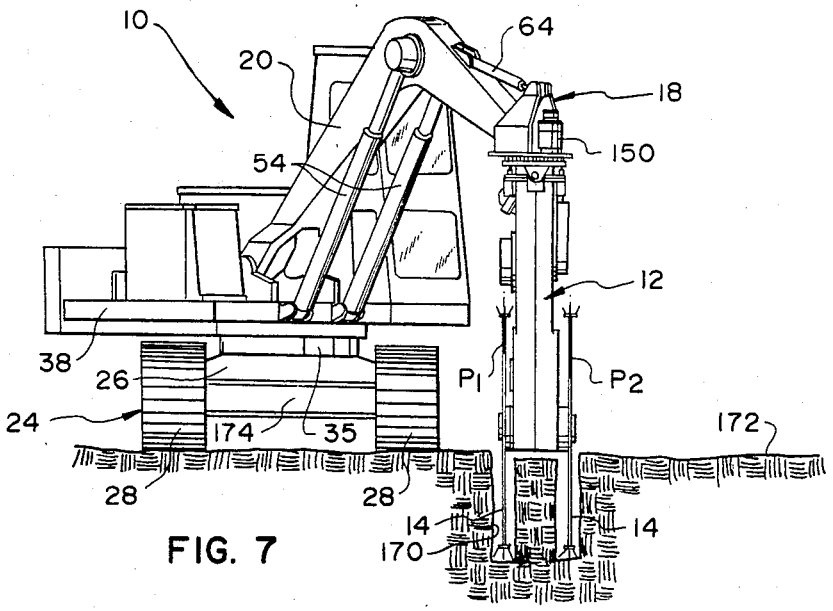
FIG. 7 is a front elevation of the apparatus in the working position shown in FIG. 6.

Referring to FIGS. 6 and 7, for example, the apparatus 10 is shown disposed alongside a trench 170 which is being cut by the saw unit 12 wherein the vehicle 22 is positioned to traverse a path generally parallel to the trench 170 and the platform 38 has been rotated about axis 40 to place the distal end 58 of the boom 20 directly above the trench. With this orientation of the apparatus 10, the head 18 is pivoted about axis 62 until axis 84 is vertical. Suitable inclinometers can be mounted on the head 18 and the saw unit 12 and read from the operator's cab 42 to indicate the position of the head and the frame 96. The saw unit 12 is then rotated about the axis 84 to place the planes of rotation of the saw wheels 14 and the axis 98 parallel to the longitudinal direction of the trench 170. As shown in FIG. 7, the undercarriage 22 is sitting on a substantially level surface 172 and, accordingly, the actuators 100*a* and/or 100*b* may be locked in position to maintain the frame 96 hanging substantially vertical in the trench 170 if the surface 172 is generally horizontal or level throughout the path of travel of the apparatus 10 to cut the trench. However, if the tracks 28 should be tilted about longitudinal axis 174 of the vehicle 22, the planes of rotation of the saw wheels 14 should be maintained vertical and thereby requiring pivotal movement of the frame 96 about the axis 98. As the vehicle 10 traverses the ground surface to cut the trench 170, the saw unit 12 must be maintained in its predetermined position about the axis of rotation 84 with respect to the boom 20 and about the axis of rotation 98 with respect to the head 18. During the initial cut of the trench 170, the motor 150 and the actuators 100*a* and 100*b* must be controlled to maintain the alignment described above. In this regard, if the trench 170 is being cut to follow a fixed longitudinal path and a fixed depth with regard to a reference point, it may be necessary to operate the actuators 54 and the platform swing motor 74 to maintain the position of the saw unit 12 relative to a reference point regardless of the irregularities in terrain encountered by the undercarriage 24. Accordingly, during an initial trench cutting operation, such as depicted in FIGS. 6 and 7, the operator of the apparatus 10 is required to maintain the alignment of the saw wheels 14 and the depth of cut with regard to the aforementioned reference point by actuation of any one or more of the actuators 54, 64, 100*a* and 100*b*, and the motors 74 and 150.

Typically, a trench cutting operation requires multiple passes of the saw unit 12 to obtain the depth of cut required as described above and in the referenced patents. In this regard, on successive passes of the saw wheels 14 through a trench which has been previously partially formed to have parallel sidewalls, the successive passes of the saw unit 12 at ever greater depths will require lowering of the boom 20 to the prescribed cutting depth, adjustment of the head 18 with respect to the boom 20 about axis 62 and adjustment of the position of the frame 96 with respect to the head 18 about the axes of rotation 84 and 98. At a cutting depth wherein the saw wheels 14 are at least partially confined by the previously formed sidewalls of a trench, such as the trench 170, the saw wheels are, of course, guided somewhat by the trench itself as they make successively deeper cuts. In this regard, it is important to allow the saw unit 12 to be free to pivot about the axes 84 and 98 as described previously and to allow the platform 38 to be free to pivot about the axis 40 when the vehicle 22 is displaced laterally from the trench a shown in FIGS. 6 and 7. In certain instances it may also be desirable to allow the head 18 to pivot freely about the axis 62. Although the operation of the saw unit 12 as described herein pertains to cutting a trench along a line generally parallel to movement of the undercarriage 24 the controls for the actuators 54, 74, 64, 150 and 100*a*, 100*b* may be set to provide for cutting trenches or other rock sawing operations in a wide variety of directions of the saw wheels 14 relative to the undercarriage 24.

Figure 9:
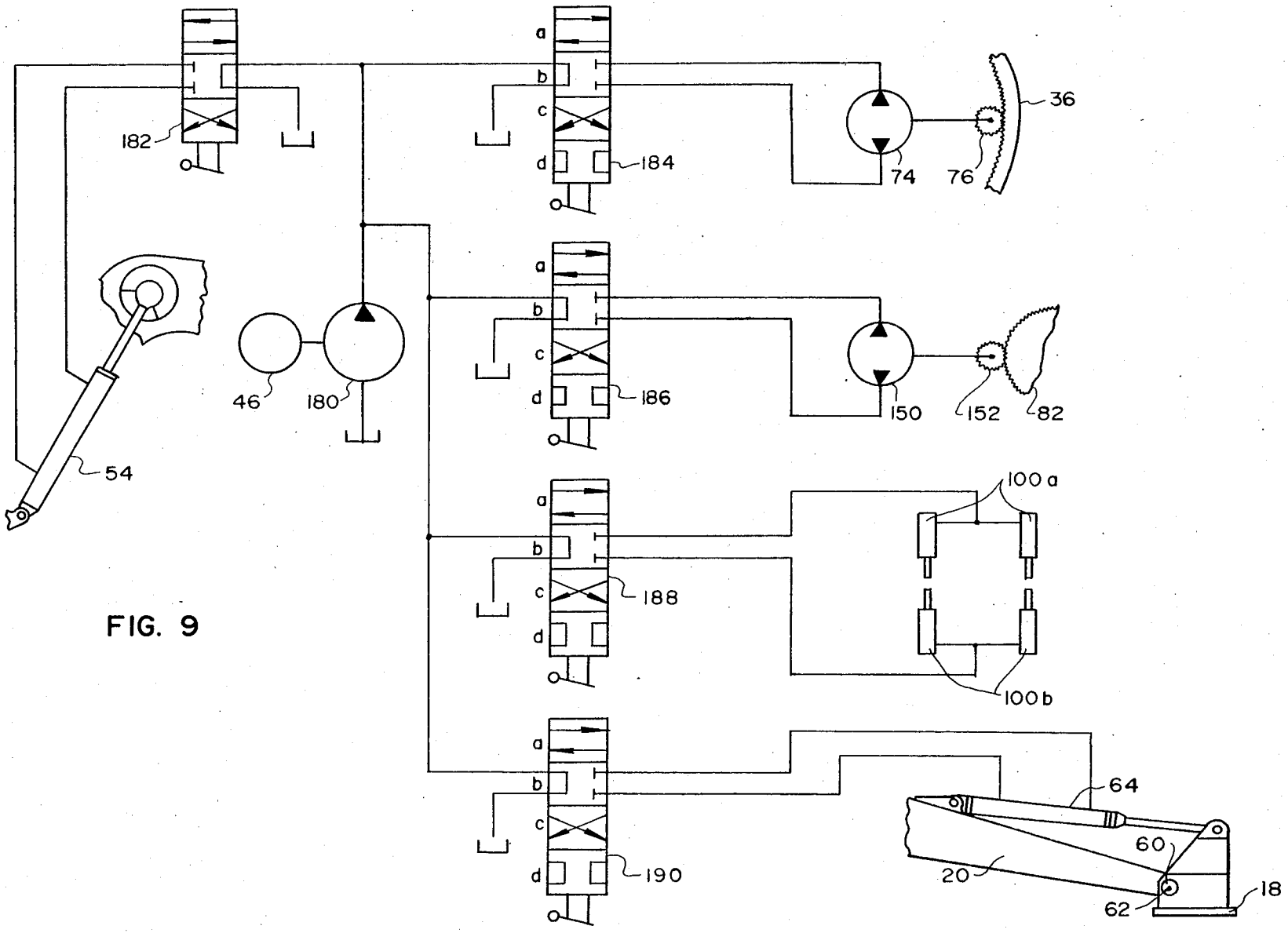
FIG. 9 is a schematic diagram of a hydraulic control circuit for positioning the saw apparatus.

Referring now to FIG. 9, there is illustrated a unique control system for the apparatus 10 wherein the actuators and motors for positioning the saw unit 12 about the respective pivot axes 40, 62, 84 and 98 may be controlled to position the saw unit in a predetermined attitude and lock the structure which is movable about the respective axes to prevent relative movement or to allow the saw unit 12 to pivot freely about the respective axes 62, 84 and 98 and to allow the platform 38 to pivot freely about the axis 40. FIG. 9 illustrates a hydraulic pump 180 which is suitably driven by the engine 46 and is operably connected to the actuators 54 through a three position control valve 182. The pump 180 is also adapted to supply hydraulic fluid to the motor 74 through a four postion control valve 184 and supply pressure fluid to the motor 150 through a similar control valve 186. The control system illustrated in FIG. 9 has been simplified to eliminate conventional pressure relief valves, counterbalance valves and other ancillary items which may typically be required in a hydraulic control circuit and is believed to be within the capability of the skilled worker in the art of hydraulic controls. The pump 180 is also adapted to supply hydraulic fluid to the actuator pairs 100*a* and 100*b* through a control valve 188 and to the actuator 64 through a control valve 190.

Each of the control valves 184 and 186 are configured as four position manually operated valves which may be selectively positioned to rotate the motors 74 and 150 in opposite directions, to lock the motors to prevent rotation of the gears 76 and 152 or to connect the fluid lines to and from the motors to each other to allow the motors to oscillate freely in opposite directions by effectively interconnecting the respective fluid inlet and discharge ports of the motors. When the valves 184 and 186 are in their positions a, pressure fluid is supplied to the motors to rotate them in one direction. When the valves 184 and 186 are each in position b, the supply of hydraulic fluid to the respective motors 74 and 150 is blocked and the respective conduits interconnecting the valves and the motors are blocked to prevent rotation of the motors thereby locking the associated mechanisms connected to the respective motors against movement. When the valves 184 and 186 are in their positions c, the respective motors 74 and 150 are operable to be rotated in the opposite direction and, when the valves 184 and 186 are in their respective positions d, the motor inlet and outlet ports of motors 74 and 150 are operably interconnected to permit free rotation of the respective motors 74 and 150 in opposite directions as determined by driving forces exerted in the gears 76 and 152 by the gears 36 and 82, respectively.

When the valve 188 is moved to its position a, the actuators 100*a* are extended and the actuators 100*b* are connected to a drain conduit through the valve 188 to force rotation of the saw unit 12 about the axis 98 in a counterclockwise direction, viewing FIG. 4. When the valve 188 is placed in its position b, the actuators 100*a* and 100*b* are operable to lock the saw unit 12 in a predetermined position relative to the head 18 since the flow of hydraulic fluid in and out of the actuators is blocked. When the valve 188 is in position c, the actuators 100*b* are extended and the actuators 100*a* are vented to force rotation of the saw unit 12 in the opposite or a clockwise direction about the axis 98, viewing FIG. 4. When the valve 188 is placed in its position d, the actuators 100*a* and 100*b* are interconnected to permit oscillatory flow of fluid between the respective actuators and to permit essentially free rotation or oscillation of the saw unit 12 about the axis 98. In like manner, when the valve 190 is placed in its positions a or c, the actuator 64 is retracted or extended, respectively, and is locked in a preselected position when the valve 190 is placed in its position b. When valve 190 is placed in its position d, the conduits leading to the cylinder actuator 64 are interconnected to each other to permit essentially free oscillation of the head 18 and the saw unit 12 about the axis 62. Although the valve 182 is shown as a three position valve which does not permit the fluid lines leading to the actuator 54 to be interconnected with each other, the valve 182 may be modified to have a fourth position like the position d for the valves 184–190, if desired. Typically, however, the position of the boom 20 about the axis 50 is positively controlled and locked in a selected position to control the depth of cut of the saw wheels 14.

Figure 8:
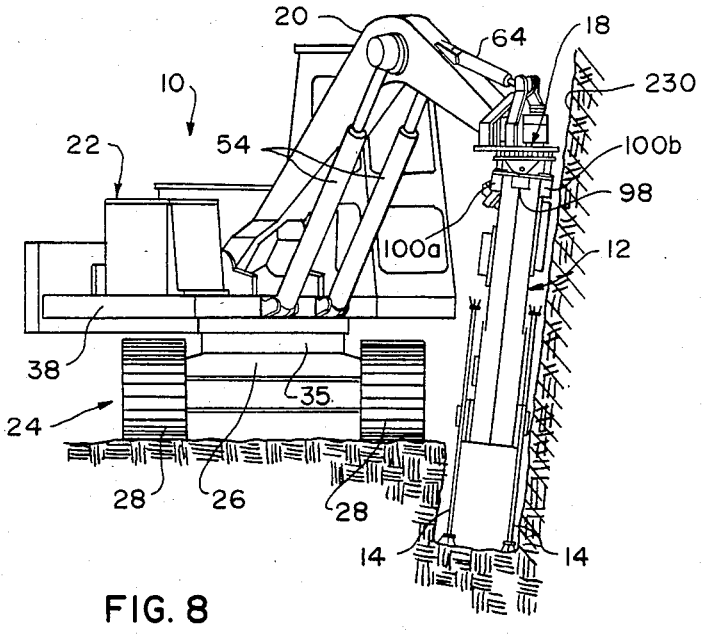
FIG. 8 is a front elevation of the apparatus shown milling an inclined rock wall.

The apparatus 10 may be used to perform cutting or milling operations other than trench cutting as described previously herein. For example, referring to FIG. 8, the saw unit 12 is illustrated in a position for milling a sloping wall 230. The actuators 100*b* have been extended to cant the saw unit 12 at an angle relative to the head 18 about pivot axis 98 whereby at least one saw wheel 14 is operable to be substantially coplanar with rock wall 230. The teeth 16 may be replaced with suitable face cutting or milling teeth, not shown, if desired. A wide range of cutting angles or attitudes of the saw unit 12 relative to the undercarriage 24 may be obtained by positioning of the saw unit 12 with the controls illustrated in FIG. 9. Various types of wall cleanup or milling operations may also be performed with the apparatus 10 with the universally positionable saw unit 12 which may be inclined with respect to the vertical over a range of angles limited by the movement of the frame 96 about the pivot axis 98. Accordingly, operations such as cleanup of quarry and tunnel walls or excavations for various types of earth structures may be carried out using the apparatus 10.

Figure 10:
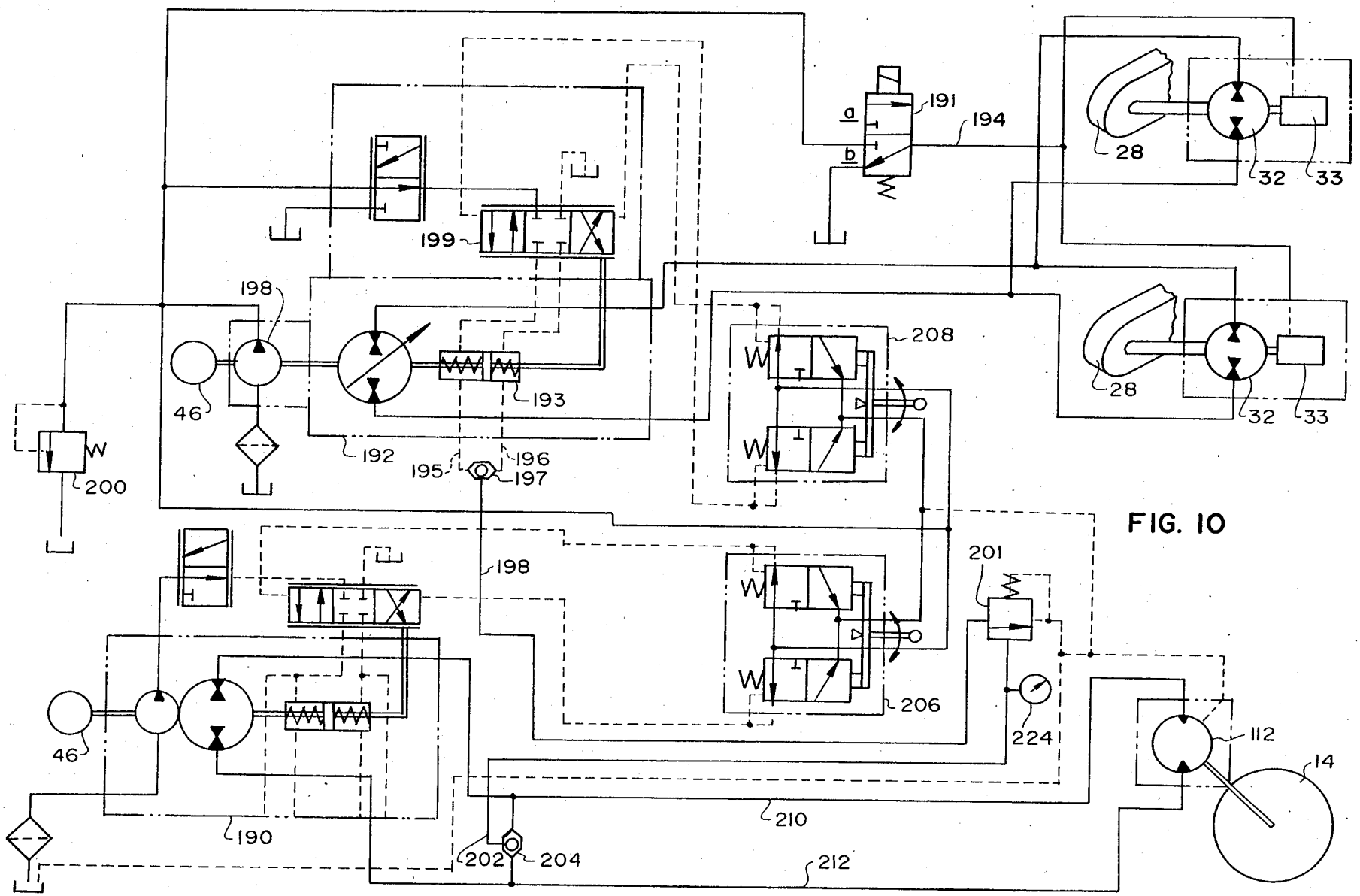
FIG. 10 is a schematic diagram of a hydraulic control system for driving the saw wheels and the undercarriage.

Referring now to FIG. 10, there is illustrated a schematic diagram of a control system for control of the propulsion motors 32 for the respective tracks 28 and for the drive motor 112 of the saw unit 12. The drive motor 112 is operable to receive hydraulic fluid from a supply pump 190 which is suitably drivably connected to the engine 46 through a power transfer gear case 47, FIG. 1, whereby the engine is operable to drive the pump 180, the pump 190 and a third pump 192 for supplying hydraulic fluid to the track drive motors 32. The propulsion motor 112 is preferably of a fixed displacement type and may comprise an axial piston bent axis type such as a series A-2 F manufactured by Rexroth Corporation, Bethlehem, Pa., U.S.A. The track drive motors 32 are preferably of a variable displacement type such as a bent axis axial piston type motor. A preferred embodiment of the motors 32 may be a type AA-6-V variable displacement hydraulic motor also manufactured by the Rexroth Corporation. The motors 32 are each provided with a remote hydraulic pilot fluid actuated control mechanism 33 which will vary the displacement of the motor in accordance with a pilot pressure control signal supplied to the motors through a common signal conduit 194 and a solenoid operated valve 196. Pressure fluid for operating the displacement control mechanisms 33 for the motors 32 may be supplied by an auxiliary pump 198 which supplies pressure fluid to the conduit 194 through a pressure limiting valve 200 which is set to supply control fluid to valve 191 at a predetermined pressure as well as control fluid to a pilot operated valve 199 for the pump 192. During operation of the saw unit 12 the motors 32 are controlled to operate in a relatively slow speed mode when the valve 191 is placed in its position a and in a maximum displacement per revolution mode when valve 191 is in its position b for tramming the vehicle 22 between work sites. The valve 191 can be selectively controlled from the operator's cab 42 for operating the motors 32 in the slow speed mode during operation of the saw unit 12.

Regardless of the position of the valve 196 and the displacement per revolution setting of the motors 32, the speed of the motors 32 may also be controlled by the quantity of fluid supplied to the motors by the pump 192. The pump 192 is preferably a variable displacement, reversible, overcenter axial piston type pump such as a model AA-4-V-40-HD manufactured also by the Rexroth Corporation. The pump 192 includes a displacement control actuator 193 which is connected to pilot operated control valve 199 and, by way of conduits 195 and 196, to a shuttle valve 197. The shuttle valve 197 is connected by way of a conduit 198 to a pressure limiting valve 201 which is in communication with the operative fluid supply conduit to the motor 112 from the pump 190 through a conduit 202 and a shuttle valve 204. The pump 190 is also preferably a variable displacement, reversible, overcenter axial piston type such as a model AA-4-V-250 HD manufactured by the Rexroth Corporation. The pump 190 includes a displacement control actuator 193 controlled through a pilot operated valve 193 which is controlled by an operator actuated valve 206. The displacement of the pump 192 may also be selectively controlled manually by a valve 208. Control fluid for the valves 206 and 208 is supplied from the pump 198 at a controlled pressure as determined by valve 200.

The control system illustrated in FIG. 10 is operable to provide substantially constant power input to the motor 112 and consequently the saw wheels 14 for maintaining a predetermined cutting rate or rate of rock removal by controlling the rate of traverse of the undercarriage 22 so that, in effect, the feed rate or "crowding" of the saw wheels 14 during a trench cutting operation is maintained relatively constant. The saw drive motor 112 may be manually controlled through the valve 206 by setting the displacement of pump 190 which is driven by engine 46 at constant speed. The pressure of the fluid supplied to the motor 112 through conduits 210 or 212 is sensed by the valve 201 through the shuttle valve 204 and conduit 202. The valve 200 is operable to vent pressure fluid from the actuator 193 in response to the pressure in conduit 210 or 212 exceeding a predetermined limit to reduce the displacement of pump 190 and thereby reduce the speed of traversal of the undercarriage 22 during operation of the saw unit 12. Accordingly, the feed rate of cutting a trench with the saw wheels 14 may automatically controlled so that a constant rate of energy input into the trench cutting or rock removal action of the saw may be carried out.

The operation of the control circuit illustrated in FIG. 10 in conjunction with the control circuit illustrated in FIG. 9 provides for an improved cutting rate for a trench cutting saw such as the saw unit 12. Thanks to the arrangement of the head 18 which provides for substantially universal positioning of the saw unit 12 with respect to the undercarriage 22, the saw unit 12 may be traversed in a predetermined path which may be manually controlled through the valves 182, 184, 186, 188 and 190 and the saw unit may be allowed to follow a trench previously cut whereby the maximum feed rate of the saw wheels 14 may be constantly controlled to provide a substantially constant rate of energy input into the trench cutting operation.

In a typical operating cycle, the pumps 190 and 192 are set manually with the valves 206 and 208 to achieve the maximum desired cutting rate of the saw unit 12 and the pressure of fluid supplied to the motor 112 is read at a gauge 224, FIG. 10. The pressure setting of valve 201 is then set at a slightly lower maximum pressure setting at which fluid will be valved from the actuator 193 by way of the shuttle valve 197 and conduit 198. When the fluid supply pressure to the motor 112 exceeds the pressure setting of valve 201, fluid is vented from the actuator 193 to reduce the displacement of the pump 192 and thereby slow the traversal rate of the undercarriage 24 to maintain the desired pressure setting at the motor 112. If the pressure in conduit 210 is less than the setting of valve 201, the pump 192 will displace fluid at the maximum setting of the pump to increase the speed of the motors 32 and tracks 28 to maintain the saw wheels 14 engaged with the rock or earth being cut so that a substantially constant feed rate is provided. Certain conventional elements such as relief valves and drain lines have been omitted from the control circuit of FIG. 10 in the interest of clarity. The tracks 28 may be selectively braked for steering the vehicle 22 in a conventional manner.

Those skilled in the art will recognize other applications for the trench cutting or rock milling saw unit 12 in conjunction with the support structure and control systems described herein. Although a preferred embodiment of the invention has been described in detail, those skilled in the art will also recognize that various substitutions and modifications may be made to the invention without departing from the scope and spirit thereof as recited in the appended claims.

What is claimed is:

1. A rotary trench cutting saw apparatus comprising:

a self propelled vehicle having an undercarriage including propulsion wheel means;

a platform mounted on said undercarriage for rotation relative to said undercarriage about a vertical axis;

an elongated boom mounted on said platform for movement about a generally horizontal pivot axis for moving said boom in a generally vertical plane, said boom having a distal end and first pivot means formed on said distal end;

a rotary saw unit mounted on said boom at said distal end, said saw unit including a saw frame for supporting rotatable saw wheel means and motor means on said frame and drivably connected to said saw wheel means;

a head mounted on said distal end of said boom for pivotal movement about a first axis formed by said first pivot means and interconnecting said saw frame with said boom, said head including second and third pivot means for pivoting said saw frame with respect to said boom about second and third axes perpendicular to each other and to said first axis, respectively;

actuator means for pivoting said saw unit about said pivot means; and control means for positioning said saw unit in a predetermined directional attitude for cutting in a predetermined path by moving said saw unit about said first, second and third axes to a predetermined position relative to said platform.

2. The apparatus set forth in claim 1 wherein:

said control means includes means for moving said boom relative to said platform and means for moving said platform about said vertical axis relative to said undercarriage.

3. The apparatus set forth in claim 1 wherein:

said saw frame is connected to said head by bearing means for rotation about said second axis and said means for pivoting said saw frame about said second axis includes reversible fluid operated motor means on one of said head and said saw frame drivably connected to a pinion, said pinion being meshed with a gear on the other of said head and said saw frame for rotating said saw frame relative to said head.

4. The apparatus set forth in claim 3 wherein:

said third pivot axis is formed by pivot means interconnecting said saw frame and said bearing means for pivoting said saw frame about said third axis, and actuator means interconnecting said saw frame and said bearing means for moving said saw frame relative to said bearing means and said head.

5. The apparatus set forth in claim 4 wherein:

said control means include means for permitting said saw unit to pivot freely about one of said first, second and third pivot axes during operation of said saw unit in cutting a trench.

6. The apparatus set forth in claim 5 wherein:

said control means includes means for controlling said motor and said actuator means to permit said saw frame to pivot freely about said second and third axes, respectively.

7. The apparatus set forth in claims 1 or 6 including:

platform motor means for rotating said platform relative to said undercarriage about said vertical axis, and said control means includes means for causing said platform motor means to rotate said platform in a selected direction and to permit said platform to pivot freely about said vertical axis.

8. The apparatus set forth in claim 1 including:

means for driving said saw wheel at a feed rate which will provide a substantially constant rate of energy output by said saw wheels in cutting a trench, said means including a hydrostatic saw wheel pump and drive motor in circuit, said saw drive motor being drivably connected to said saw wheel means;

means for traversing said undercarriage including hydraulic propulsion motor means drivably connected to said propulsion wheel means, and a hydraulic pump operably connected to said propulsion motors means; and control means associated with said saw drive motor including a pressure responsive valve for sensing the pressure of fluid delivered to said saw drive motor and means for controlling the rate of traverse of said undercarriage by adjusting the output speed of said propulsion motor means to maintain a substantially constant pressure of fluid input to said saw drive motor.

9. The apparatus set forth in claim 8 wherein:

said pump connected to said propulsion motor means is a variable displacement pump including hydraulic pump displacement actuator means, and said valve is operable to control the flow of pressure fluid to said actuator means to adjust the fluid output rate of said pump for controlling the speed of said propulsion motor means.

10. A rotary rock cutting saw unit for mounting on a movable boom, said saw unit comprising:

a frame including first support means for supporting at least one rotary saw wheel for rotation relative to said frame;

at least one rotary saw wheel supported on said first support means;

motor means on said frame drivably connected to said saw wheel;

a head including second support means for supporting said saw for pivotal movement on and relative to said boom; and means forming a connection between said head and said frame for positioning said frame relative to said head about two mutually perpendicular axes, at least one of said axes is parallel to the plane of rotation of said saw wheel whereby said saw wheel may be traversed along a trench and maintained in alignment with a predetermined traverse of said saw wheel.

11. The saw unit set forth in claim 10 wherein:

said second support means for supporting said head on said boom operatively provides for pivotal movement of said saw unit about a first axis, and said means forming said connection operatively provides for pivotal movement of said frame relative to said head about a second axis perpendicular to said first axis, and pivotal movement of said frame relative to said head about a third axis perpendicular to said second axis.

12. The saw unit set forth in claim 11 wherein:

said second axis intersects said third axis.

13. The saw unit set forth in claim 12 including:

a second saw wheel mounted on said frame spaced from and coaxial with said first saw wheel, said second axis intersecting the axis of rotation of said saw wheels and spaced substantially equidistant between the planes of rotation of said saw wheels.

14. A rotary trench cutting saw apparatus comprising:

a rotary saw unit including a frame and at least a first rotary rock cutting saw wheel rotatably mounted on said frame about an axis of rotation;

a positioning head connected to said frame and including means forming a first pivot connection for rotating said frame about a first pivot axis relative to said head and means forming a second pivot connection for rotating said frame relative to said head about a second pivot axis, said first and second pivot axes being mutually perpendicular to each other and to said axis of rotation, said head including means for mounting said saw unit on a support boom;

actuator means for pivoting said frame with respect to said head about said first and second pivot axes, respectively; and control means for operating said actuator means to positively position said frame relative to said head about said first and second pivot axes and to selectively permit oscillation of said frame about one of said first and second pivot axes to permit said saw unit to be guided by said trench during the cutting thereof.

15. The apparatus set forth in claim 14 wherein:

said saw unit includes a second saw wheel mounted for rotation about said axis of rotation and spaced laterally from said first saw wheel; and said second pivot axis extends in a plane perpendicular to said axis of rotation and substantially equidistant between the planes of rotation of said saw wheels.

16. The apparatus set forth in claim 14 wherein:

said actuator means comprises a first actuator for pivoting said frame relative to said head about said first pivot axis and second actuator means for pivoting said frame relative to said head about said second pivot axis.

17. The apparatus set forth in claim 16 wherein:

said means for forming said first pivot connection comprises bearing means for supporting said frame on said head, a first gear connected to one of said head and said frame, a second gear meshed with said first gear and drivably connected to reversible fluid motor means mounted on the other of said head and said frame, and said control means includes valve means for valving pressure fluid to said motor to selectively rotate said head in opposite directions, said valve means being operable to provide for said motor means to oscillate freely in response to forces acting on said saw wheels tending to pivot said frame about said first axis.

18. The apparatus set forth in claim 16 wherein:

said means forming said second pivot connection includes pivot pin means interconnecting said frame and said head, and said second actuator means includes a pair of linear fluid cylinder actuators mounted on one of said head and said frame on opposite sides of said second pivot axis and operably connected to the other of said frame and said head, and said control means includes valve means for selectively connecting one of said cylinder actuator to a source of pressure fluid for pivoting said frame about said second pivot axis and for interconnecting said cylinder actuators to permit said frame to oscillate freely with respect to said head about said second pivot axis in response to forces acting on said saw wheels tending to pivot said frame about said second pivot axis.

19. A rotary trench cutting saw apparatus comprising:

a self propelled vehicle having an undercarriage including propulsion wheel means;

an elongated boom mounted on said undercarriage;

a rotary saw unit mounted on said boom, said saw unit including a saw frame for supporting rotatable saw wheel means and motor means on said frame and drivably connected to said saw wheel means;

a head mounted on a distal end of said boom for pivotal movement about at least a first axis formed by first pivot means and interconnecting said saw frame with said boom;

means for driving said saw wheel means at a feed rate which will provide a substantially constant rate of energy output by said saw wheel means in cutting a trench, said means including a hydrostatic saw wheel pump and drive motor in circuit, said saw drive motor being drivably connected to said saw wheel means;

means for traversing said undercarriage including hydraulic propulsion motor means drivably connected to said propulsion wheel means, a hydraulic pump operably connected to said propulsion motor means; and control means associated with said saw drive motor including a pressure responsive valve for sensing the pressure of fluid delivered to said saw drive motor and means for controlling the rate of traverse of said undercarriage by adjusting the output speed of said propulsion motor means to maintain a substantially constant pressure of fluid input to said saw drive motor.

20. The apparatus set forth in claim 19 wherein:

said pump connected to said propulsion motor means is a variable displacement pump including hydraulic pump displacement actuator means, and said valve is operable to control the flow of pressure fluid to said actuator means to adjust the fluid output rate of said pump for controlling the speed of said propulsion motor means.

* * * * *